US007559182B2

(12) United States Patent
Lindberg

(10) Patent No.: US 7,559,182 B2
(45) Date of Patent: Jul. 14, 2009

(54) METHOD AND ARRANGEMENT FOR PLACING REEL END SHIELDS

(75) Inventor: Harri Lindberg, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 11/793,950

(22) PCT Filed: Dec. 22, 2005

(86) PCT No.: PCT/FI2005/000546

§ 371 (c)(1),
(2), (4) Date: Jul. 19, 2007

(87) PCT Pub. No.: WO2006/067272

PCT Pub. Date: Jun. 29, 2006

(65) Prior Publication Data

US 2008/0006008 A1 Jan. 10, 2008

(30) Foreign Application Priority Data

Dec. 23, 2004 (FI) ..... 20041663

(51) Int. Cl.
*B65B 61/22* (2006.01)

(52) U.S. Cl. ..... 53/136.2; 53/204; 53/415

(58) Field of Classification Search ..... 53/409, 53/410, 415, 461, 485, 128.1, 135.1, 136.2, 53/204; 414/801, 802
See application file for complete search history.

(56) References Cited

U.S. PATENT DOCUMENTS 3,393,492 A * 7/1968 Lamon et al. ..... 53/136.2
3,924,375 A * 12/1975 Brenner et al. ..... 53/370.3
3,942,638 A * 3/1976 Stone ..... 53/415
4,201,028 A * 5/1980 Melehan ..... 53/136.2
4,303,462 A * 12/1981 Karr ..... 53/136.2
4,339,904 A * 7/1982 Koutonen et al. ..... 53/136.2
4,498,276 A * 2/1985 Reed ..... 53/204

(Continued)

FOREIGN PATENT DOCUMENTS

EP 0 499 954 A1 8/1992

(Continued)

*Primary Examiner*—Louis K Huynh
(74) *Attorney, Agent, or Firm*—Cohen Pontani Lieberman & Pavane LLP

(57) ABSTRACT

The invention relates to a method and arrangement for placing end shields on the ends of paper, pulp, or board reels (1) in connection with packing. The arrangement comprises at least one first conveyor (1) for transporting the reels (3) in a direction parallel to their axes and at least one station (4) for placing at least one inner end shield on the end of a reel (5). Next to the first conveyor (1) there are elements (8, 9) for placing an inner end shield and after the station there are elements (1) for changing the direction of the axis of the reel (5), relative to the first direction of travel, after the placing of the inner end shields, and elements for placing at least one outer end shield on the end of the reel. Further, the arrangement comprises elements (11) for making the direction of travel of the reel to deviate from the first direction of travel prior to the placing of the outer end shield, and end-shield collection stations, which are located within the operating area of one element placing the end shields, so that this element can transfer both inner and outer end shields for placing.

11 Claims, 1 Drawing Sheet

U.S. PATENT DOCUMENTS

| | | | | | |
|---|---|---|---|---|---|
| 4,534,151 | A | * | 8/1985 | Schneck et al. | 53/136.2 |
| 4,596,108 | A | * | 6/1986 | Piesen et al. | 53/136.2 |
| 4,633,650 | A | * | 1/1987 | Sohlberg et al. | 53/136.2 |
| 4,679,376 | A | * | 7/1987 | Ekblom | 53/136.2 |
| 4,840,008 | A | * | 6/1989 | Hood et al. | 53/136.2 |
| 4,958,478 | A | * | 9/1990 | Hannen et al. | 53/136.2 |
| 5,046,298 | A | * | 9/1991 | Norkoski et al. | 53/136.2 |
| 5,265,399 | A | * | 11/1993 | Niskanen et al. | 53/136.2 |
| 5,392,585 | A | * | 2/1995 | Wall | 53/136.2 |
| 5,533,321 | A | * | 7/1996 | Hooper et al. | 53/136.2 |
| 5,642,600 | A | | 7/1997 | Hooper et al. | |
| 5,706,945 | A | * | 1/1998 | Saarinen et al. | 53/461 |
| 5,761,881 | A | * | 6/1998 | Wall | 53/136.2 |
| 5,907,941 | A | * | 6/1999 | Fukuzumi et al. | 53/136.2 |
| 5,960,608 | A | * | 10/1999 | Ohtonen | 53/136.2 |
| 5,971,590 | A | | 10/1999 | Nieminen et al. | |
| 6,678,928 | B2 | * | 1/2004 | Wallace | 53/136.2 |
| 2008/0053044 | A1 | * | 3/2008 | Makinen | 53/136.2 |

FOREIGN PATENT DOCUMENTS

| | | | |
|---|---|---|---|
| EP | 0 610 662 | A1 | 2/1993 |
| EP | 0 610 759 | | 3/1993 |
| FI | 57561 | | 5/1980 |
| FI | 864854 | | 5/1988 |
| FI | 90959 | | 1/1994 |
| FI | 92172 | | 6/1994 |
| FI | 95228 | | 9/1995 |
| GB | 2 044 713 | | 10/1980 |
| GB | 2 197 842 | | 2/1988 |

* cited by examiner

METHOD AND ARRANGEMENT FOR PLACING REEL END SHIELDS

PRIORITY CLAIM

This is a national stage of application No. PCT/FI2005/000546, filed on Dec. 22, 2005. Priority is claimed on application No. 20041663, filed in Finland on Dec. 23, 2004.

BACKGROUND OF THE INVENTION

The present invention relates to a method for placing the end shields of paper, board, or pulp reels, in connection with the packaging of the reels. In the method, the reel to be packaged is brought to a wrapping station and inner end shields are first fastened to the ends of the reel and a wrapping material is wrapped on top of the surface of the jacket of the reel and outer end shields are placed on the ends, after which the reel is moved away from the wrapping station.

The invention also relates to an arrangement intended to apply the method.

A wide paper reel coming from a paper machine is first of all taken to a slitter-winder and cut into customer reels of a suitable width. Next, the reels are packaged for transporting. When packaging paper reels, inner end shields are first of all placed on their ends, after which the necessary amount of wrapping is wrapped around them, the ends of which are folded on top of the inner end shields on the ends of the reels. An outer end shield is usually glued by hot sealing on top of the folded end of the wrapping and the inner end shield. The inner end shield is usually quite thick and its task is to protect the end of the reel from mechanical damage. For its part, the outer end shield is thinner and its task is to hold the packaging onto the end of the reel and to protect the reel from moisture. Colouring and patterns are often used on the outer end shield to try to give the reel a tidy appearance. The length and diameter of the reel to be packaged are measured prior to packaging and on the basis of the measurement results end shields of a suitable size are selected for the reel ends. A reel packaging line usually comprises several consecutive stations, by means of which the necessary operations are performed. Reels are moved between stations by a conveyor or by rolling.

The end shields can be placed on the end of the reels in many different ways. Placing the shield by hand is the oldest method and one that is still suitable for packaging lines with a reasonably small capacity, or in installations in which there is no need to increase the degree of automation. The packer then simply places the inner shields by hand on the ends of the reel and the outer shields correspondingly on the heat-pressing plates, which press the outer shields onto the ends of the reel. The inner shields can also be transferred by an air blast or by hand without mechanical contact. The inner shields are held on the end on the reel on a separate arm, or by an air blast while the edges of the wrapping are folded. The outer shields are, in turn, attached to the press plates by vacuum suction and are pressed onto the ends of the reel using the press plates. When setting the shields by hand, the packer ensures that shields of the correct size are put on the reel and that they are positioned correctly.

Various kinds of automatic end-shield setters have already been used for a long time and several different kinds of them exist. Nearly all the automatic shield setters have the common feature that at each end of the reel there is a device comprising a grab, which transfers a shield from the stack of shields to the end of the reel. In one known shield setter, there is a rotating arm mounted on a vertical guide, at the end of which arm there is a rotating vacuum sucker for gripping the shields. Shield setters of this kind are normally used in conjunction with racks of shield shelves located next to the setter. Using such a device, the shields are placed on the end of the reel, in such a way that the arm of the grab is moved along the vertical guide to the height of the shelf on which there are end shields of the correct size. The grab arm and sucker are turned, until the sucker is aligned parallel to the plane of the shelf, after which the shield is picked up from the shelf and the arm and sucker are moved to the reel end by rotating them and moving them along the guide. Instead of shelves, the end shields can be placed in stacks on the mill floor, or in a rotating shield magazine.

Instead of the aforementioned manner of handling end shields, a standard-model industrial robot with several degrees of freedom can be used to handle shields. A robot of this kind can be located in connection with the wrapping station, in such a way that it can place an end shield on both ends of the reel. The efficient operation of the robot requires a two-sided grab to be used, by means of which the grab can be rotated to pick up shields for both ends can be picked up one after the other, so that two lifting movements will not be required. It is also possible to use two robots to achieve a shorter stage time. Because the inner end shields must be placed before wrapping, or in connection with making the jacket wrapping, and the outer end shields correspondingly after folding the ends, in practice the inner and outer shields must be placed at different processing stations. In practice, there is no space at the jacket-wrapping station for the outer-end-shield press station, so that the reel must be moved from the wrapping station to the outer-end-shield press station to attach the end shields. This transfer distance can be several metres, because there must be sufficient space at the different stations for wide reels while the operating devices required for reel handling take up their own space. Thus, separate devices must be arranged for placing the inner and outer end shields. For example, the reach of conventional industrial robots is insufficient for handling both shields. It is obvious that it is expensive to use two industrial robots or similar devices.

End shields can also be placed on the reel ends from stacks on the mill floor, by using portal-action shield setters. The transfer portal is constructed above the shield stacks and the shield setters are generally installed on the same transversely movable guide. There is a separate shield setter for each side of the reel and each shield setter must have its own stack of end shields of a specific size. The end-shield stacks are placed in a matrix pattern on the floor of the mill hall. There are usually separate handling devices for the inner and outer end shields. This solution, like the use of industrial robots, is very suitable for packing lines requiring a large capacity and a short stage time.

SUMMARY OF THE INVENTION

The present invention is intended to create an improved method and arrangement for placing the end shields of paper, board, or pulp reels in connection with their packing, in which method only a single end-shield setter is used for both inner and outer end shields.

The invention is based on the reel being packed being moved, after the setting of the inner end shields and the jacket wrapping, away form the wrapping station in a direction parallel to its axis, the direction of movement of the reel being changed, preferably through 90° from its original direction of movement towards the end-shield setter.

Considerable advantages are gained with the aid of the invention.

The most important advantage of the method is the considerable savings that accrue from the fact that packing can be implemented with the aid of only a single industrial robot or portal manipulator. These are both, together with their ancillary devices, still expensive devices. The handling of the end shields is facilitated, because the end shields are brought to only one location within the reach of the end-shield setter. This makes it easier to plan the transportation of the end shields from the store to the point of use. The end shields can also be placed by hand, in which case only one operator supervising the equipment will be enough for placing the shields. If the reel is moved continuously over a direct path from one processing station to another, there is bound to be too great a distance from the inner end-shield placing station to the end-shield press station, so that in this case at least two operators will be required. This will not be possible in countries with a high wage level.

BRIEF DESCRIPTION OF THE DRAWINGS

In the following, the invention is examined in greater detail with the aid of the accompanying drawing, which shows one arrangement according to the invention, seen from above.

DETAILED DESCRIPTION OF THE PREFERRED EMBODIMENTS

Figure 1:
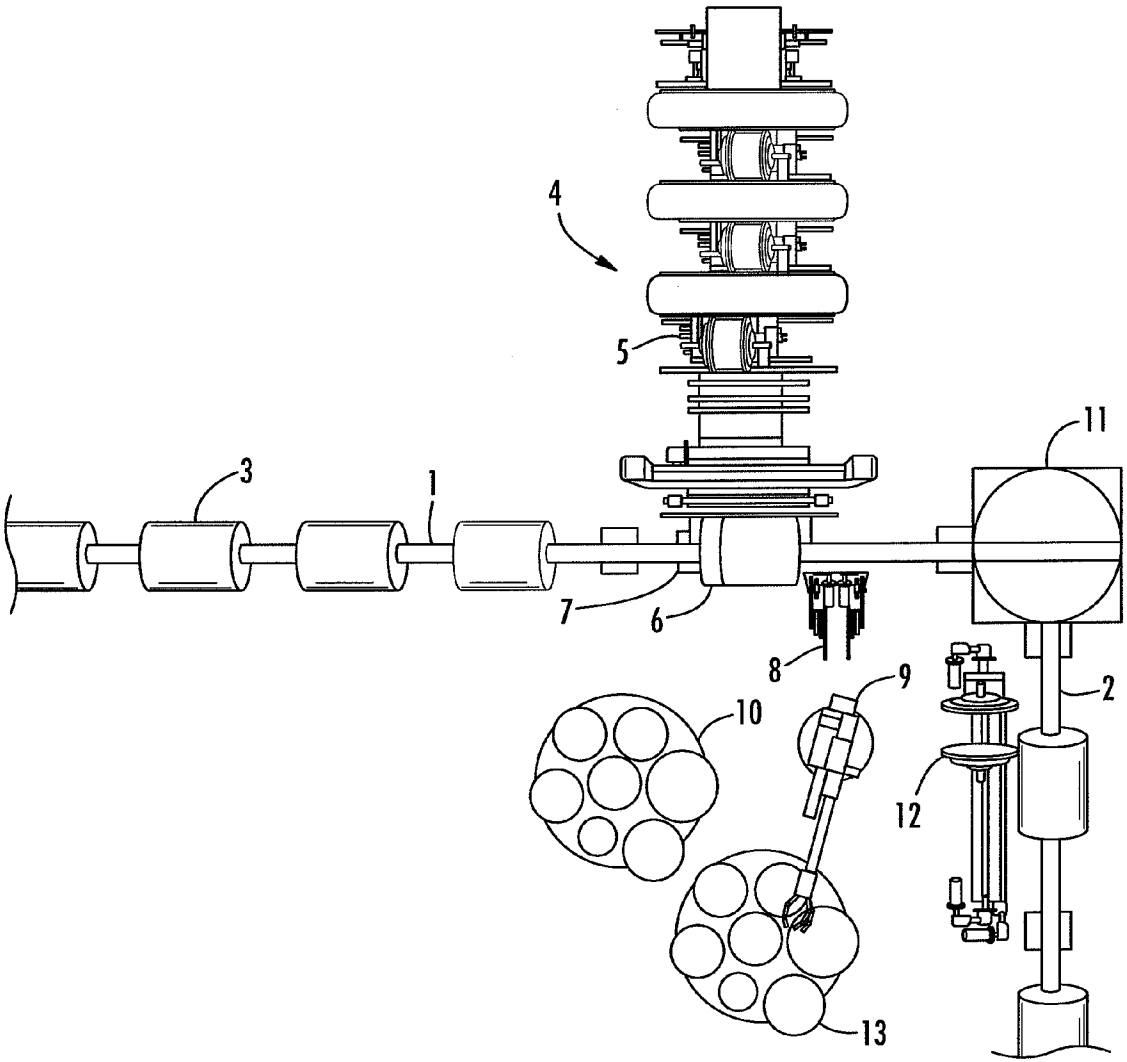

The packing system consists of a conveyor 1, 2 and reel-handing devices. The reels 3 being packed are brought to the wrapping station 4 by the first conveyor 1. The wrapping station 4 comprises, for example, several wrapping rolls 5, from which the jacket wrapping is fed to the reel 6 being packed, carrier rolls 7 for rotating the reel 6, and of course the necessary elements for controlling the movements of the wrapping 5 and the reel 6. In this case, the reel wrapping is formed from several wrapping layers wrapped parallel to each other. Other wrapping methods are spiral wrapping and wrapping with a single wide wrapping layer, which covers the reel and forms folds at the ends of the reel. Each method of wrapping has its own advantages and the present invention is suitable for use in connection with any kind of wrapping method at all. For placing the inner end shields, there are intermediate setters 8 at the wrapping station, an industrial robot 9 with several degrees of freedom, and a rotating end-shield magazine 10.

The conveyor 1 continues past the wrapping station 4 to a turntable 11. The turntable 11 is a device, by means of which the reel can be guided from the first conveyor 1 to a second conveyor 2, which runs in a different direction to the first conveyor. In this case, the angle between the first 1 and the second 2 conveyors is 90° and the second conveyor and its direction of travel are arranged, relative to the direction of travel of the first conveyor, on the side with the end-shield setter, i.e. the industrial robot 9. Immediately after the turntable in the direction of travel of the reels 3, 6, come the outer-end-shield press plates 12. In this example, the press plates 12 are located advantageously between the second conveyor 2 and the industrial robot 9. For the outer end shields, a second rotating end-shield magazine 13 is located in the lifting area of the industrial robot 9. In this way, the reach of the industrial robot 9 becomes sufficient for transferring both the inner and outer end shields.

Packing of the reels 3 using the arrangement described above can be performed, for example, in the following manner.

In this case, the transfer of the inner end shields is implemented with the aid of intermediate setters 8, of which there is one for the end of the reel 6 on each wrapping station. In this case, the transfer of the end shields is carried out by the industrial robot 9 using a two-sided grab to lift a suitably-sized end shield from the first end-shield magazine 10 and transferring them to the intermediate setter 8. The intermediate setter 8 takes the shield to the ends of the reel 6 and, if necessary, holds them in place until part of the jacket wrapping has been folded over the end of the reel, when the end shield will remain in place by itself. If an intermediate setter or similar is not used, the end shields can be envisioned as being taken directly to the ends of the reel. Shield holders will then be required at each end of the reel, or else the robot's grab must be constructed in such a way that it can hold the end shield against the end of the reel for a moment while the fold is made. If the inner end shields are transferred to the reel in this way, the wrapping stage will be quite slow, but on the other hand the number of operating devices will be reduced. When the system is being designed, the manner of operation must of course be adapted according to the capacity required.

Once the jacket wrapping of the reel being packed is ready, the reel 5 is moved from the wrapping station 4 in the direction parallel to the axis of the reel and the direction of travel of the conveyor 1 to the turntable 11 at the end of the conveyor 1. The turntable 11 is a device, by means of which the reel can be carried and its direction of travel changed by turning the turntable. In this case, the direction of travel of the reel is changed by 90°. The turning direction is on the industrial robot side relative to the direction of travel of the first conveyor 1. The second conveyor 2, to which the reel is guided after being turned on the turntable, is located at 90° to the first conveyor 1. Immediately after the turntable 11 in the direction of travel of the reel is the outer-end-shield press 12, which is placed in such a way that the lifting area of the end-shield press plates is within the area of movement of the industrial robot. Generally, it is advantageous for the outer end shields to be placed directly onto the press plates, but in this case too an intermediate setter can be used, either to accelerate the stage time or to move the press station away from the area of movement of the robot. The placing of the end shields takes place simply in such a way that, at some suitable stage of the work cycle, the industrial robot 9 transfers the outer end shields from the magazine 13 to the press station 12. The press station can operate entirely independently from the robot and attach the end shields to the reel always according to when the reel is pushed from the conveyor 2 to the press station. The ready packed reel is pushed from the station 12 back to the conveyor and taken, for example, to a warehouse.

The invention has embodiments that differ from those disclosed above.

Instead of a turntable, other operating devices too can be used to change the direction of the reel. For example, it is possible to envisage the second conveyor being arranged in a direction parallel to that of the first conveyor, but being on the opposite side of the industrial robot. In that case, the end-shield magazines would be placed separately from each other and the press station 12 would be placed between them, next to the industrial robot. The transfer from the first conveyor 1 to the second could be made transversely by rolling, or by using a transverse, single-carriage transveyor. The direction of travel of the second conveyor can be the same as that of the first conveyor, or opposite to it. If the direction of travel of the second conveyor is the same as that of the first conveyor, the reel will continue to move away from the robot, or other shield setter. In that case, intermediate setters running beside the second conveyor will be required, which will transfer the outer end shields to the intermediate setters. The first and second conveyors are preferably parallel to each other. The greatest distance between them is determined by the reach of the robot or other shield setter. The robot should be able to transfer the shield to the intermediate setter travelling next to the second conveyor.

The turning angle of the turntable or other turning device can be other than 90°. It can then be envisaged, that there would be an acute or obtuse angle between the first and second conveyors. Of these, an acute angle would appear to be more advantageous in terms of the area of movement of the robot. The turning can also be performed away from the shield setter, in which case intermediate setters travelling next to the second conveyor will again be needed. However, allowance must be made for the fact that, if the movements of a portal device become long, shield setting will become quite slow, so that the movement cannot be located over a very wide area. What is essential is that the end-shields stacks are located in the lifting station of a device in the operating area of a single operator or automatic shield setter, in such a way that the same agent can place both inner and outer end shields for setting. In this case, the term operating area refers to the operating area defined by the reach of an automatic shield setter, or such an area of movement of the operator in which they can safely and reliably move to set both end shields in place or in an intermediate setter. Shields can be brought from the location of the shield stacks from a conveyor or other operating device, which brings the shields to the lifting station.

The outer-end-shield press station 12 is preferably between the conveyor and the shield setter. If the reach of the shield setter is sufficient, the conveyor can run between it and the press station. The figure shows only two conveyors. In principle, the conveyors can be of any type at all and there can be several of them. For example, the first conveyor can be divided into shorter parts.

What is claimed is:

1. An apparatus for placing end shields on ends of paper, pulp, or board reels in connection with packing, comprising:

at least one first conveyor for transporting the reels in a first direction parallel to their axes;

an inner end shield placing device next to the at least one first conveyor for placing an inner end shield on at least one end of a reel;

a means positioned downstream of the at least one first conveyor for changing a travel direction of the reel relative to the first direction of travel after the placing of the inner end shields on the reels and before placing outer end shields on the reel;

an outer end shield placing device for placing at least one outer end shield on at least one end of the reel; and an end-shield magazine in which at least one of inner end shields and outer ends shields are collected, wherein the end-shield magazine is located within an operating area of the end shield placing devices.

2. The apparatus of claim 1, wherein the means for changing the direction of travel of the reel is a turntable.

3. The apparatus of claim 2, wherein the inner end shield placing device and the outer end shield placing device comprise a single industrial robot.

4. The apparatus of claim 2, wherein the outer end shield placing device comprises press plates and an industrial robot.

5. The apparatus of claim 4, further comprising a second conveyor for moving the reel to the press plates, wherein the press plates are arranged between the industrial robot and the second conveyor.

6. The apparatus of claim 1, wherein the inner end shield placing device and the outer end shield placing device comprise a single industrial robot.

7. The apparatus of claim 1, wherein the inner end shield placing device comprises press plates and an industrial robot.

8. The apparatus of claim 1, wherein the outer end shield placing device comprises press plates and an industrial robot.

9. The apparatus of claim 8, further comprising a second conveyor for moving the reel to the press plates, wherein the press plates are arranged between the industrial robot and the second conveyor.

10. The apparatus of claim 1, wherein the means for changing the direction of travel of the reel causes the direction of travel of the reel to deviate to that side of the first conveyor on which the inner end shield placing device and the outer end shield placing device are situated.

11. The apparatus of claim 10, wherein the inner end shield placing device and the outer end shield placing device comprise a single industrial robot.

* * * * *